US005505655A

United States Patent [19]

Haffely et al.

[11] Patent Number: 5,505,655

[45] Date of Patent: Apr. 9, 1996

[54] ADJUSTABLE TOOL PLATFORM AND AN ABRADING MACHINE INCLUDING THE SAME

[75] Inventors: Jeffrey L. Haffely, Gibsonia; Xun Lei, Cheswick; Louis C. Brickner, Pittsburgh, all of Pa.

[73] Assignee: Delta International Machinery Corp., Pittsburgh, Pa.

[21] Appl. No.: 286,357

[22] Filed: Aug. 9, 1994

[51] Int. Cl.[6] ..... B24B 41/00

[52] U.S. Cl. ..... 451/340; 451/65

[58] Field of Search ..... 451/340, 65, 406, 451/364, 377, 380, 387, 393, 282, 293

[56] References Cited

U.S. PATENT DOCUMENTS

| | | | |
|---|---|---|---|
| 720,912 | 2/1903 | Gorton | 451/282 |
| 1,013,760 | 1/1912 | Gardner | 451/282 |
| 2,386,283 | 10/1945 | Wiken et al. | 451/340 |
| 2,490,614 | 12/1949 | Bedford | 451/377 |
| 2,997,900 | 8/1961 | Pugsley | 451/340 |
| 3,782,046 | 1/1974 | Schaap et al. | 451/406 |
| 4,574,530 | 3/1986 | Handler et al. | 451/340 |

OTHER PUBLICATIONS

Technical Brochure for Reliant Models GGM–250B and GGM–250W Bench Dry/Wet Grinders, Publication Date Unknown.

Instruction Manual for Makita Sharpener Model 9820–2 of Makita Electric Works, Ltd., Dated 1985.

Instruction Manual for Delta Model No. 23–700 Wet/Dry Grinder, Delta International Machinery Corp., Pittsburgh, PA, Dated Mar. 15, 1988.

AMT Power Tool Catalog, Depicting AMT Model No. 4881 Horizontal Wet Wheel, American Machine and Tool Company, Royersford, PA, Dated Fall 1994.

Delta Building Trades and Home Shop Machinery Catalog, depicting on pp. 73–74 the Delta Model No. 23–680 6 "Bench Grinder Model No. 23–980 10" Bench Grinder, Model No. 23–880 8 Bench Grinder, Model No. 23–580 5 Bench Grinder, and Model No. 23–660 6 Bench Grinder, Delta International Machinery Corp., Pittsburgh, PA, Dated Jan. 1994.

*Primary Examiner*—Bruce M. Kisliuk
*Assistant Examiner*—Derris H. Banks
*Attorney, Agent, or Firm*—Kirkpatrick & Lockhart

[57] ABSTRACT

An abrading machine includes a tool platform for supporting a tool at a selected elevation and angular position relative to an abrading surface of the abrading machine. The tool platform includes a tool rest member, having a tool-receiving surface, which is movably attached to a carriage assembly which is, in turn, movably received by a support assembly. An abrading machine having two or more abrading stations and an adjustable tool platform moveable between the abrading stations is also provided.

46 Claims, 12 Drawing Sheets

ADJUSTABLE TOOL PLATFORM AND AN ABRADING MACHINE INCLUDING THE SAME

BACKGROUND OF THE INVENTION

1. Field of the Invention

The present invention relates to tool platforms, and particularly relates to tool platforms which include a tool-receiving surface which may be selectively disposed at a given angular orientation and elevation relative to an abrading surface of an abrading apparatus. The present invention more particularly relates to an abrading machine including a tool platform having a tool-receiving surface which may be selectively disposed at a given angular orientation and elevation relative to the abrading machine's abrading surface, and most particularly relates to a two-station abrading machine having an adjustable tool platform which may be selectively disposed at either station, and wherein a preselected elevation and angular orientation of the tool-receiving surface relative to the abrading surface may be maintained when the tool platform is moved between stations.

2. Description of the Invention Background

A number of modern tools and machines include portions having engageable edges which must be kept free from surface imperfections such as, for example, burrs, nicks and gouges, so that the tool or machine can function properly. For purposes of the present disclosure, the operation wherein such surface imperfections are removed from an edge will be referred to as "grinding". Such tools which should be maintained free from surface imperfections include, for example, flat head screwdrivers, chisels, gouges, the cutter members of planes, spokeshaves and scrapers, and the knife members of planer machines and jointer machines. The presence of surface imperfections on such tools can mar or gouge the surface of a wooden workpiece, requiring additional sanding operations to obtain an acceptable appearance for the workpiece.

In addition to the removal of surface imperfections, a number of tools and machines include edges which must be kept sharp so that the tool or machine can properly cut or remove wood from a workpiece. For purposes of this disclosure, the operation of providing a tool with a sharpened edge will be referred to as "sharpening". Such tools which must be kept sharpened to operate properly include, for example, all types of knife tools, woodworking chisels and gouges, and the knife blades of planer machines and jointer machines.

The operations of both grinding and sharpening, as well as any other activity where material is removed from a surface of a workpiece, will be referred to herein as "abrading".

Perhaps the most rudimentary means for maintaining an edge free from burrs and nicks and/or to sharpen the edge is to use a stone surface, known as a whetstone, oilstone or a bench stone. Such stones may be composed of natural stone or artificial material, such as silicon carbide or aluminum oxide, and come in a variety of grit sizes. By the repeated stroking of a worn edge on the stone at the proper angle, material is abraded from the edge.

To remove surface imperfections from the edge, or to straighten the edge, a stone having a coarse or medium grit size is typically used. To sharpen the edge, a stone having a relatively fine grit size is employed. To properly sharpen an edge, oftentimes both procedures must be employed so that relatively gross surface imperfections are first removed from the edge using a medium or coarse grit stone, and then the edge may be sharpened using a relatively fine grit stone.

When sharpening an edge by subjecting the edge to one or both of the above abrading steps, a constant angle should be maintained between the tool and the abrading surface so that the edge is not sharpened in a rounded configuration. Maintaining a constant angle when sharpening by hand using a stone is quite difficult, in part because the tool must be stroked across the stone surface while maintaining substantially constant pressure between the edge and the stone.

To hasten the removal of material from an edge to be ground or sharpened, and also to aid in maintaining a proper angle between the tool and the abrading surface, a variety of motor-driven grinding and sharpening devices are available. These devices may be capable of either grinding or sharpening, or may provide both features. Many of these abrading devices employ a wheel of a natural or synthetic abrasive material which is driven to rotate by an electric motor.

On such device is the Model GGM-250W grinding/sharpening machine distributed under the trade name Reliant by Trendlines, Chelsea, Massachusetts, which incorporates an 80 grit grinding wheel which rotates on a horizontally-disposed axis and a water-fed 800 grit sharpening wheel which rotates on a vertically-disposed axis. For the purpose of the following description, an abrasive wheel used for grinding which rotates on a horizontally-disposed axis is referred to as a "vertical grinding wheel", while an abrasive wheel used for sharpening which rotates on a vertically-disposed axis is referred to as "a horizontal sharpening wheel". The Reliant machine includes individual tool rests including flat metal pieces which are fixedly attached adjacent each wheel for resting the tool which is to ground or sharpened. A surface of the flat metal piece acts as a tool-receiving surface for supporting the tool to be abraded. The tool rest adjacent the vertical wheel can be adjusted to move out from or toward the perimeter surface of the wheel. The tool rest adjacent the horizontal sharpening wheel includes a flat metal strip having a tool-receiving surface, the flat metal strip having two ends, each of the ends being pivotally connected to one end of a cylindrical post member by a threaded screw and a nut. Each post member is slidingly received in a substantially vertical orientation by collar shaped portion of the machine's housing.

Each of the post members of the Reliant machine must be raised or lowered by hand within the collar-shaped portions to adjust the flat metal strip to a predetermined elevation above the wheel surface and thereby adjust a tool resting on the tool-receiving surface of the flat metal strip to a predetermined elevation above the wheel surface. To secure the individual post members at a selected elevation, a knob member must be threadedly advanced into the side of each collar portion of the machine's housing until it impinges on a surface of the post members and frictionally retains the post members at a selected depth within the collar.

The tool-receiving surface of the Reliant machine may be adjusted to a predetermined angle relative to the wheel surface by pivoting by hand the flat metal strip relative to the vertically-disposed post members. The flat metal strip may be secured at the predetermined angle by hand-tightening each of the two nut-and-screw arrangements which pivotally connect the flat metal strip to the post members.

From the foregoing description of the Reliant machine, it will be understood that the adjustment of the tool-receiving surface of the machine's tool rest adjacent the horizontal sharpening wheel must be accomplished entirely by hand and requires the hand-tightening of no less than four elements to lock the tool rest at a selected elevation and angle relative to the abrading surface. In addition, because the tool-receiving surface of the Reliant machine is disposed on a flat metal strip is supported at its terminal ends, the strip, and consequently the tool-receiving surface, may bow if the tool is pressed onto it with sufficient force. The bowing of the strip will affect the elevation and angle of the supported tool relative to the abrading surface and may also effect the pressure exerted on the abrading surface by the tool edge being sharpened. Finally, maintaining the identical orientation, i.e., elevation and angle, of the tool edge being sharpened to the abrading surface when the tool is transferred between the vertical grinding wheel and the horizontal sharpening wheel of the Reliant machine would be quite difficult because each wheel includes an individual, separately adjustable tool rest.

American Machine & Tool Co, Inc. ("AMT"), Royersford, Pa. and Woodworker's Supply, Albequerque, N. Mex., distribute grinding/sharpening machines which have substantially the same design as the Reliant machine. Adjacent to both the AMT and Woodtek machine's vertical and horizontal wheels are disposed individual tool rests having designs and means for adjustment substantially identical to that of the Reliant machine described above. Accordingly, those machines suffer from the same disadvantages as the Reliant machine.

In addition to the above devices, Makita Electric Works, Ltd., Aichi, Japan, distributes a Model 9820-2 sharpening machine which includes a single sharpening station having a 1000 grit, water-fed, horizontal sharpening wheel. Disposed adjacent the wheel is a tool rest including a support rail having a tool-receiving surface for supporting a tool for sharpening. The support rail is pivotally mounted on one end of two post members by two pin members, the other end of each post member including screw threads thereon and being slidingly received by apertures in the machine's housing.

The depth of the post members within the apertures of the Makita machine, and the consequent elevation of the tool-receiving surface above the wheel surface, is selectively adjusted by threadedly advancing by hand an individual nut member along the threaded second end of each post member; the nut members rest on the aperture's opening and cause the post member to advance into or out of the aperture when rotated. When the post members have been brought to a selected elevation, they may be locked at that elevation by hand tightening two knob members which are threadedly disposed through the machine's housing and which impinge on the post members within the housing when the knob members are sufficiently threadedly advanced into the housing. To adjust the angle of the tool-receiving surface relative to the wheel surface, the first end of one post member threadedly receives a knob member with a threaded end that passes through and may be advanced or retracted through the post member. The threaded end of the knob member protrudes from the post member and impinges in a lower surface of the support rail such that the advancement or retraction of the threaded end through the post member correspondingly pivots the support member toward or away from the wheel surface.

The Makita machine suffers from each of the disadvantages referred to with regard to the Reliant, AMT and Woodtek machines. In addition, the Makita machine does not incorporate a separate grinding wheel and either the grinding operation precedent to sharpening the edge must to accomplished using another machine or the 1000 grit wheel of the Makita machine must be replaced with a relatively coarse grit wheel.

Considering the above-described disadvantages of grinding and/or sharpening machines including tool rests, there exists a need for a new tool platform for supporting a tool adjacent the abrading surface of a grinding or sharpening machine, which tool platform includes easily adjustable means for selecting a given orientation for the tool-receiving surface of the tool rest relative to the abrading surface and for locking the tool-receiving surface in the selected orientation. A need also exists for an abrading machine including an easily adjustable tool platform, and for an abrading apparatus having two or more abrading stations and which also includes a tool platform having means for maintaining an orientation of the tool platform's tool-receiving surface relative to the abrading surface at multiple abrading station.

SUMMARY OF THE INVENTION

To address the above-stated disadvantages of the existing tool rests and abrading machines, the present invention provides an adjustable tool platform for selectively disposing a tool at a predetermined elevation and angular position relative to the abrading surface of an abrading machine. The tool platform of the present invention includes a support assembly which has an attachment portion for attaching the support assembly to an abrading machine. The tool platform of the present invention also includes a carriage assembly, which is received on and is moveable relative to the support assembly, and a tool rest member which is movably connected to the carriage assembly. The tool rest member includes at least a tool-receiving surface on which the tool to be abraded is received.

Because it is positioned on the tool rest member, which is in turn movably connected to the carriage assembly, the tool-receiving surface is moveable relative to the abrading surface so that a selected angular position and elevation of the tool-receiving surface relative to the abrading surface may be achieved. In this way, a tool received on the tool-receiving surface may be adjusted to a predetermined angular position and elevation relative to the abrading surface.

The tool platform of the present invention further includes angular position selecting means operably connected to the tool rest member to allow for adjustment of the tool-receiving surface to the above-mentioned selected angular position relative to the abrading surface, thereby also adjusting a tool received on the tool-receiving surface to the above-mentioned predetermined angular position relative to the abrading surface. In addition, elevation selecting means are also provided which are operably connected between the carriage assembly and the attachment assembly to allow for adjustment of the tool-receiving surface to the above-mentioned selected elevation relative to the abrading surface, thereby also adjusting a tool received on the tool-receiving surface to the above-mentioned predetermined elevation relative to the abrading surface.

The present invention also provides for an abrading machine which includes the tool platform of the present invention, and further provides for an abrading machine having multiple abrading stations, wherein the tool platform of the present invention may be selectively positioned at multiple abrading stations thereof while maintaining the same selected elevation and angular position of the tool-receiving surface relative to the abrading surface.

BRIEF DESCRIPTION OF THE DRAWINGS

For the present invention to be easily understood and readily practiced, a preferred embodiment will now be described in conjunction with the following figures, wherein.

DETAILED DESCRIPTION OF THE PREFERRED EMBODIMENT

Figure 1:
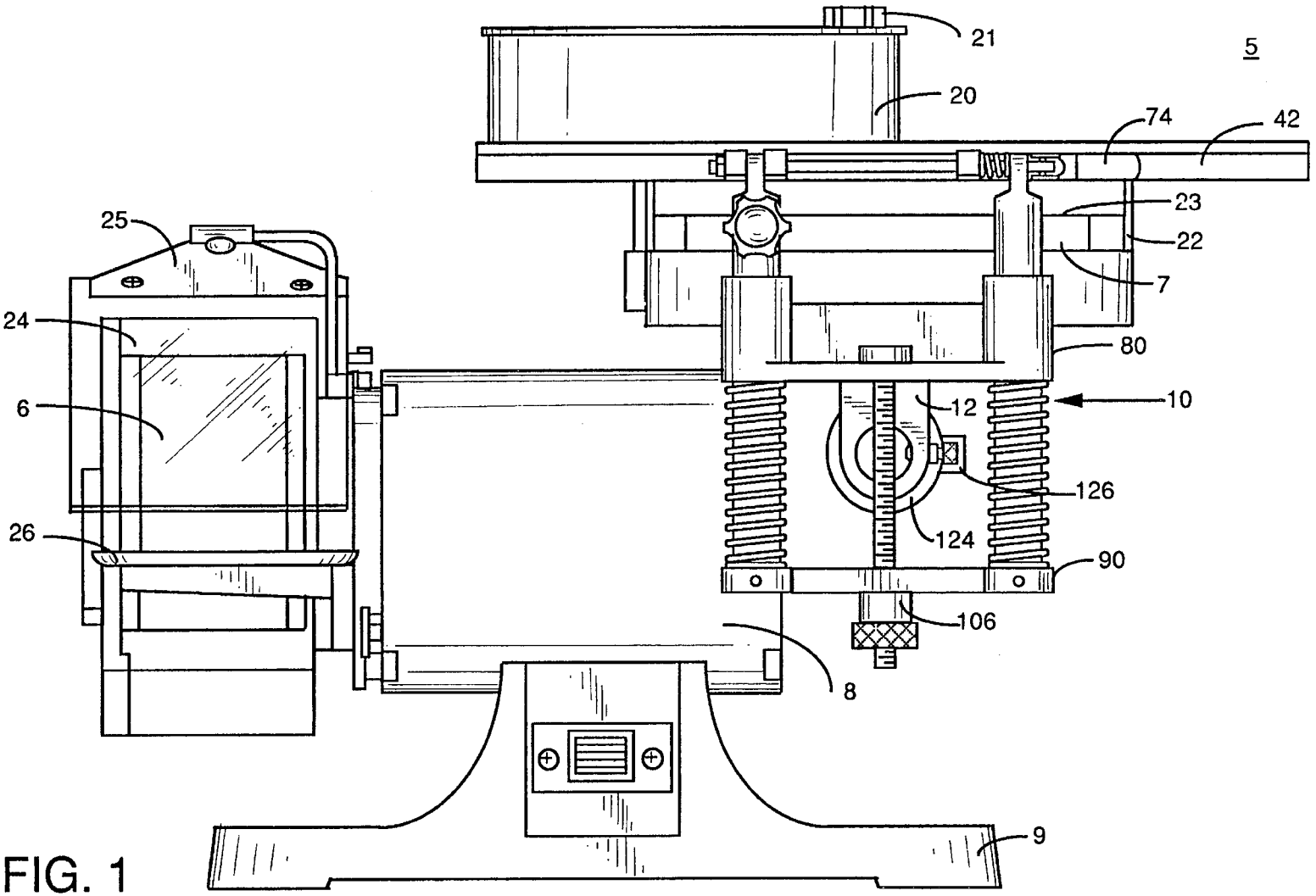
FIG. 1 is a front elevational view of the preferred embodiment of the two-station abrading machine of the present invention showing the preferred embodiment of the adjustable tool platform of the present invention disposed adjacent the horizontal sharpening wheel of the abrading machine.

An abrading machine 5 of the present invention is generally shown in FIG. 1. The abrading machine is a two-station machine including vertical grinding wheel 6 and horizontal sharpening wheel 7. Both wheels 6 and 7 are selectively driven to rotate by motor 8 mounted on base 9. The exterior design of abrading machine 5, including the ornamental and functional features thereof, is also depicted in our co-pending United States design patent application entitled "Grinding and Sharpening Machine", Application Ser. No. 29/026,701, filed on even date herewith, the entire disclosure of which is hereby incorporated by reference.

Horizontal sharpening wheel 7 is a water-fed wheel of a design familiar to those in the art and includes water reservoir 20 which feeds water onto the sharpening surface 23 of horizontal sharpening wheel 7. The water feed rate to sharpening surface 23 is adjusted by water feed adjustment knob 21. Cowling 22 surrounds a portion of the perimeter of horizontal sharpening wheel 7. Abrading machine 5 further includes housing 24, which surrounds the perimeter of vertical grinding wheel 6 so as to expose only a portion of wheel to an operator, and also includes transparent safety shield 25 and tool placement member 26 which provides a surface on which to rest a tool to be ground on vertical grinding wheel 6.

Figure 2:
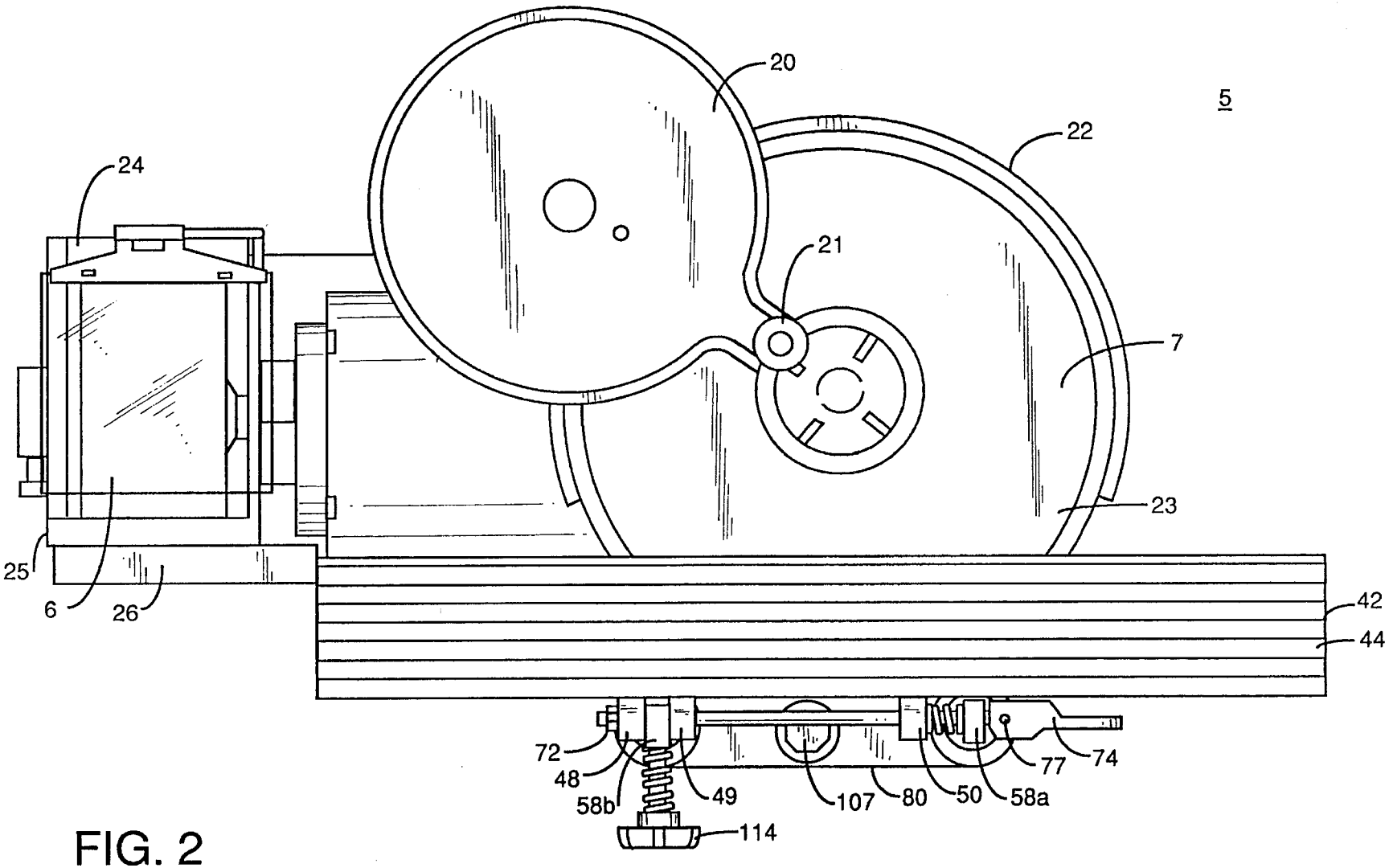
FIG. 2 is a top view of the abrading machine illustrated in FIG. 1.

As shown in FIGS. 1 and 2, abrading machine 5 also includes adjustable tool platform 10 of the design of the present invention. Tool platform 10, shown in isolation in FIGS. 3 and 4 and in an assembly view in FIG. 5, includes a support assembly which includes attachment portion 12 and support member 14.

Figure 5:
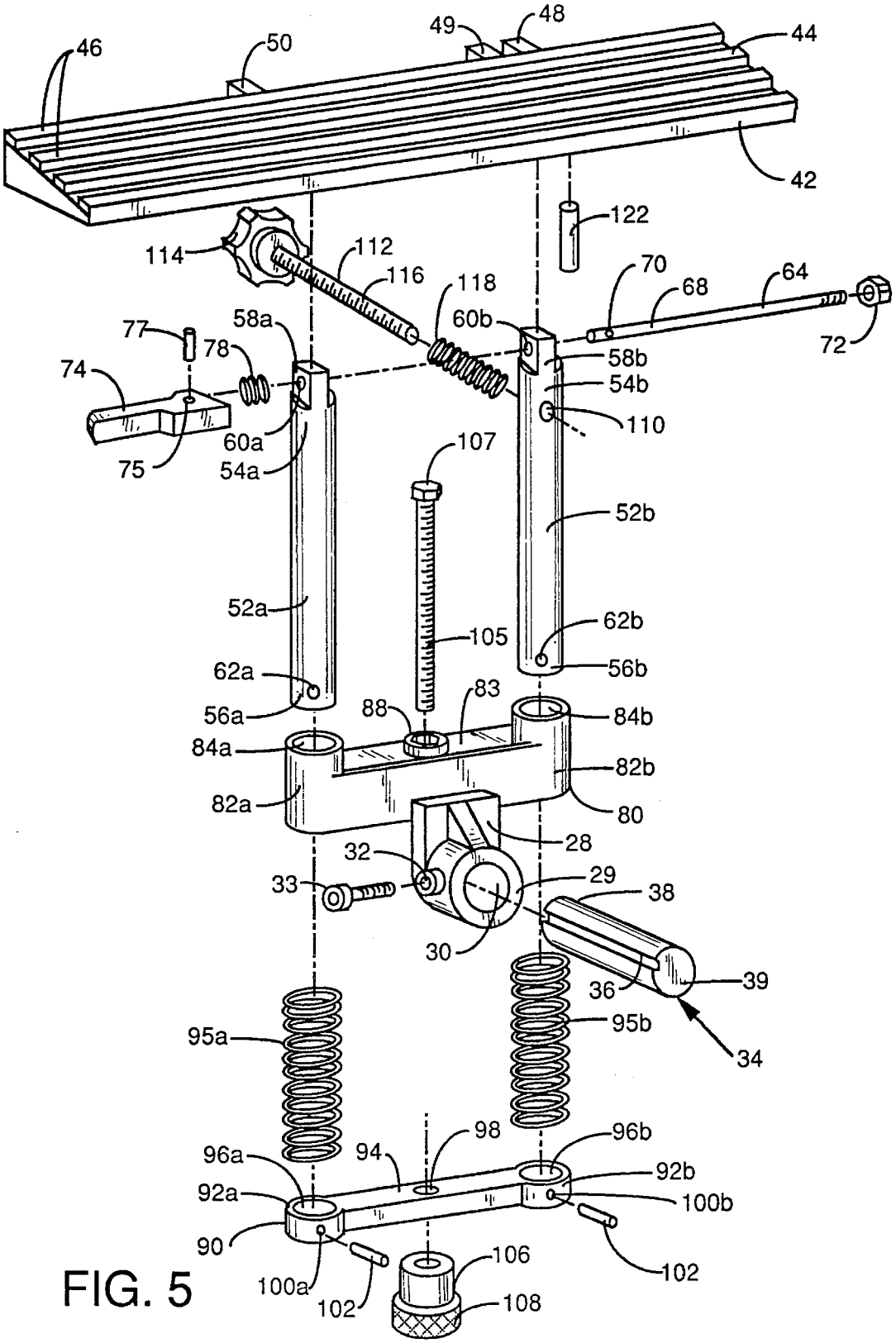
FIG. 5 is an assembly view of the tool platform of FIG. 3.
Figure 11A:
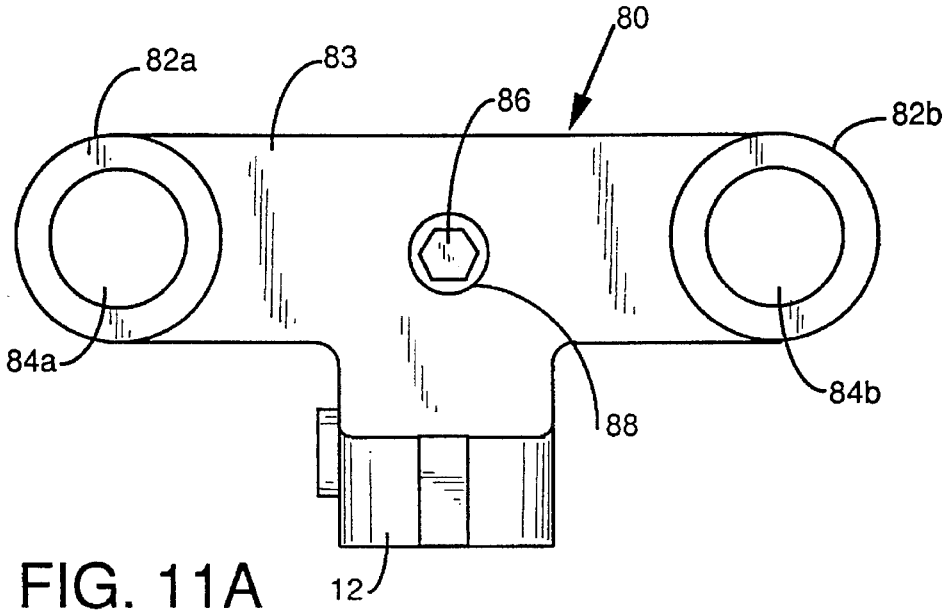
FIG. 11A is a top view of the preferred configuration for the bracket member of the tool platform of the present invention.
Figure 11B:
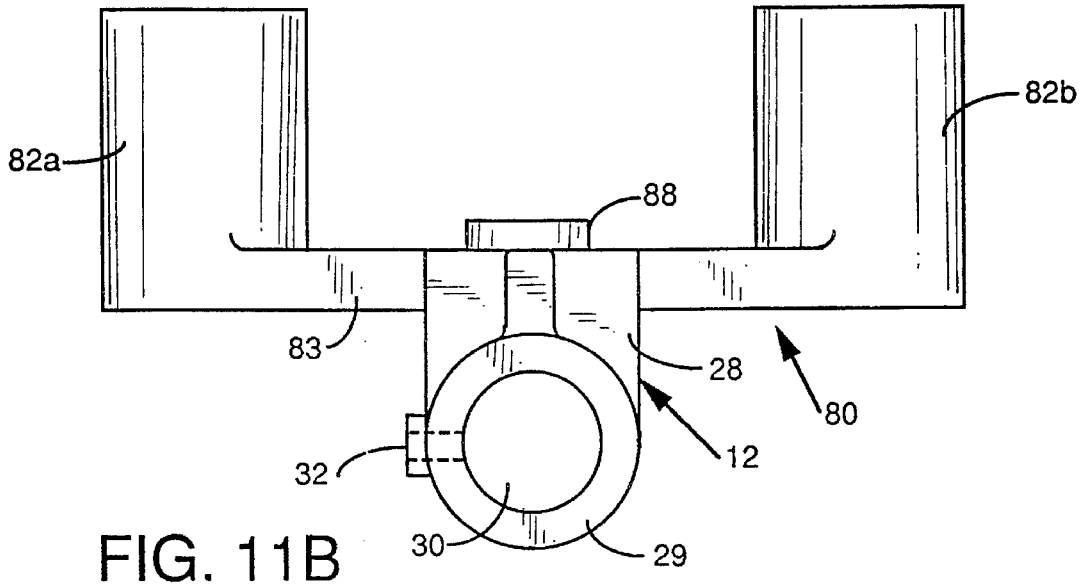
FIG. 11B is a front elevational view of the bracket member illustrated in FIG. 11A.

As best shown in FIGS. 5, 11A and 11B, attachment portion 12 includes mounting member 28 having circular wall 29 which defines circular first bore 30. Threaded bolt 33 is threadedly received in threaded second bore 32 through circular wall 29 such that threaded bolt 33 may be advanced into first bore 30. First end 38 of a preferably substantially cylindrical stalk member 34, having longitudinally-disposed slot 36 on the surface thereof, is received in first bore 30 such that when the end of bolt 33 protrudes into first bore 30, bolt 30 is fixedly disposed in slot 36.

As depicted in FIG. 1 and described in detail below, second end 39 of stalk member 34 may be disposed in a portion of abrading machine 5 configured to matingly receive the second end 39. In this way, adjustable tool platform 10 may be releasibly attached to abrading machine 5.

Although the present preferred embodiment of adjustable tool platform 10 includes attachment portion 12 to releasibly connect the tool platform 10 to an abrading machine having an attachment means configured to receive second end 39 of stalk member 34, it is to be understood that the tool platform 10 of the present invention may have an attachment portion configured in any way necessary so as to releasibly or fixedly connect the tool platform to an abrading machine. For example, the tool platform may be welded or fixedly bolted to an abrading machine such that it is not easily removable. In addition, the herein-described design for tool platform 10 could be modified such that it is a free-standing device which is disposed adjacent, but is not connected to, abrading machine 5. Such alternate designs are intended to be encompassed by the present invention.

Figure 3:
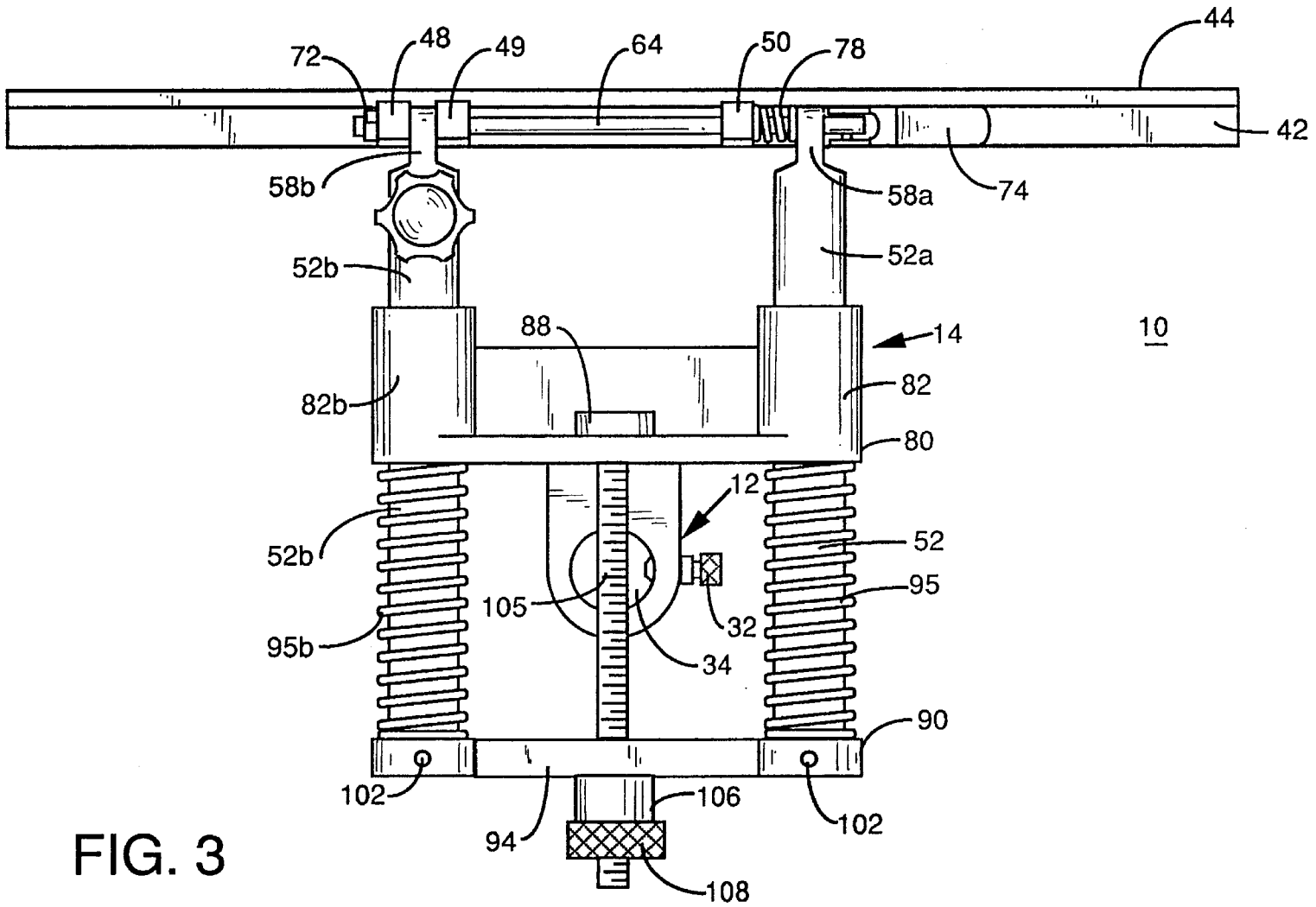
FIG. 3 is a front elevational view of the preferred embodiment of the adjustable tool platform of the present invention.
Figure 4:
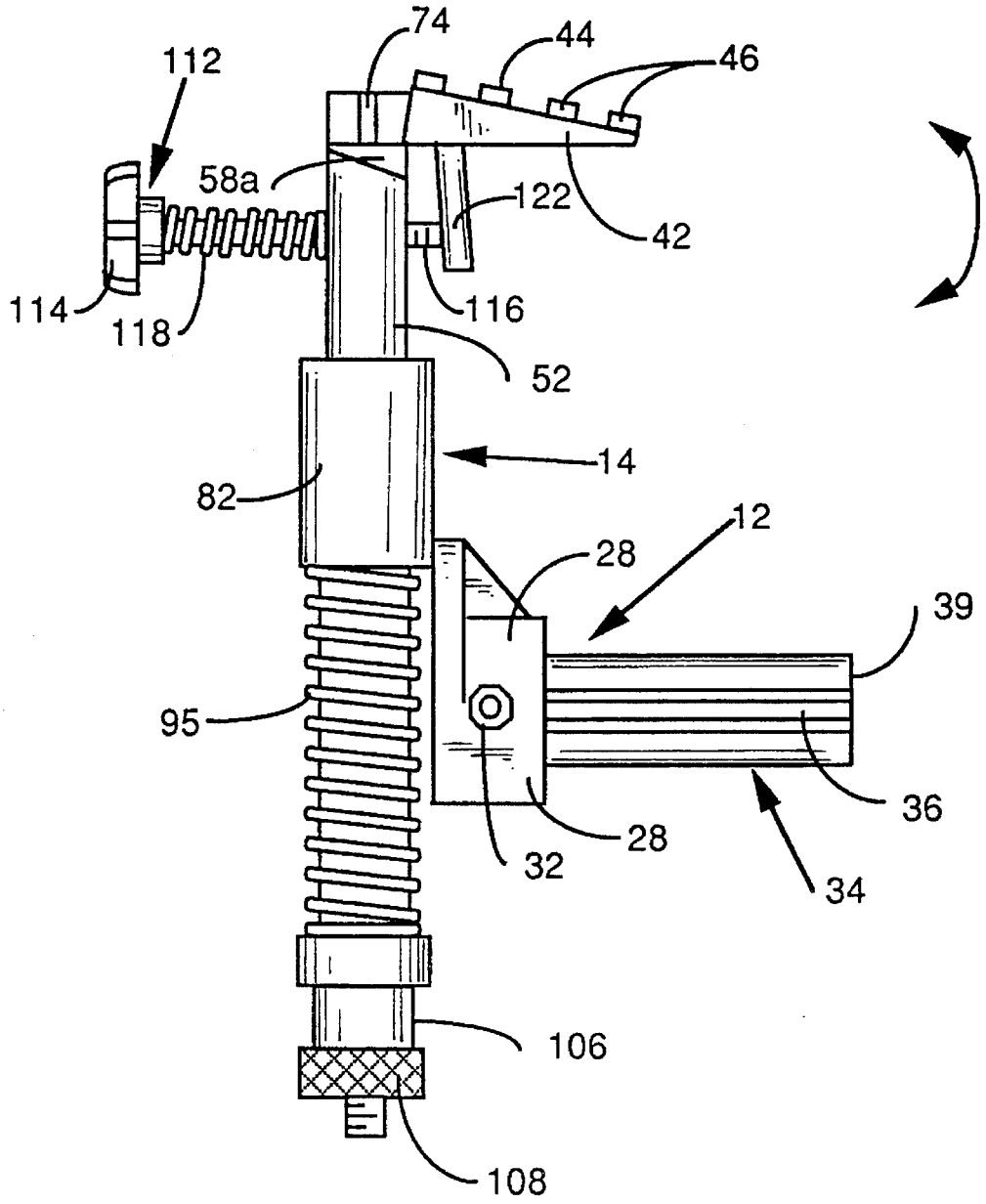
FIG. 4 is a side elevational view of the tool platform illustrated in FIG. 3.

As shown in FIGS. 1–3, in addition to attachment portion 12, tool platform 10 includes tool rest member 42 having a tool receiving surface 44 thereon for supporting a tool having an edge which is to be ground or sharpened on an abrading machine. As shown in the Figures, tool rest member 42 is preferably of a generally rectangular shape and has a substantially triangular cross-section through a longitudinal axis thereof. As best shown in FIG. 4, tool receiving surface 44 preferably includes raised bars 46 which aid to reduce friction between the tool or other item received on the tool receiving surface 44. Such item received on the tool receiving surface 44 may be, for example, the tool fixture described and claimed in our co-pending United States patent application entitled "Tool Fixture For Abrading Apparatus", application Ser. No. 286,358, filed on even date herewith, the entire disclosure of which is hereby incorporated by reference.

Tool rest member 42 also includes hinge projections 48, 49 and 50, which extend from one side of tool rest member 42. Each hinge projection 48, 49 and 50 includes a first hinge bore (not labeled) therethrough and the hinge projections are disposed along a common side of tool rest member 42 so that the longitudinal axes of the first hinge bores of hinge projections 48, 49 and 50 are aligned.

In addition to the above elements, tool platform 10 of the present invention further includes first and second post members 52*a* and 52*b*, respectively, which are preferably oblong (i.e., have a length dimension which is greater than a width dimension) and are preferably substantially cylindrical in shape. Each of post members 52*a* and 52*b*, respectively, include a first post end 54*a* and 54*b*, and a second post end 56*a* and 56*b*. Each first post end 54*a* and 54*b*, respectively, is stepped on either side to define an upstanding hinge tab 58*a* and 58*b* which each include a second hinge bore 60*a* and 60*b* therethrough. Each second post end 56*a* and 56*b*, respectively, includes a single retaining aperture 62*a* and 62*b* therethrough.

Figure 6:
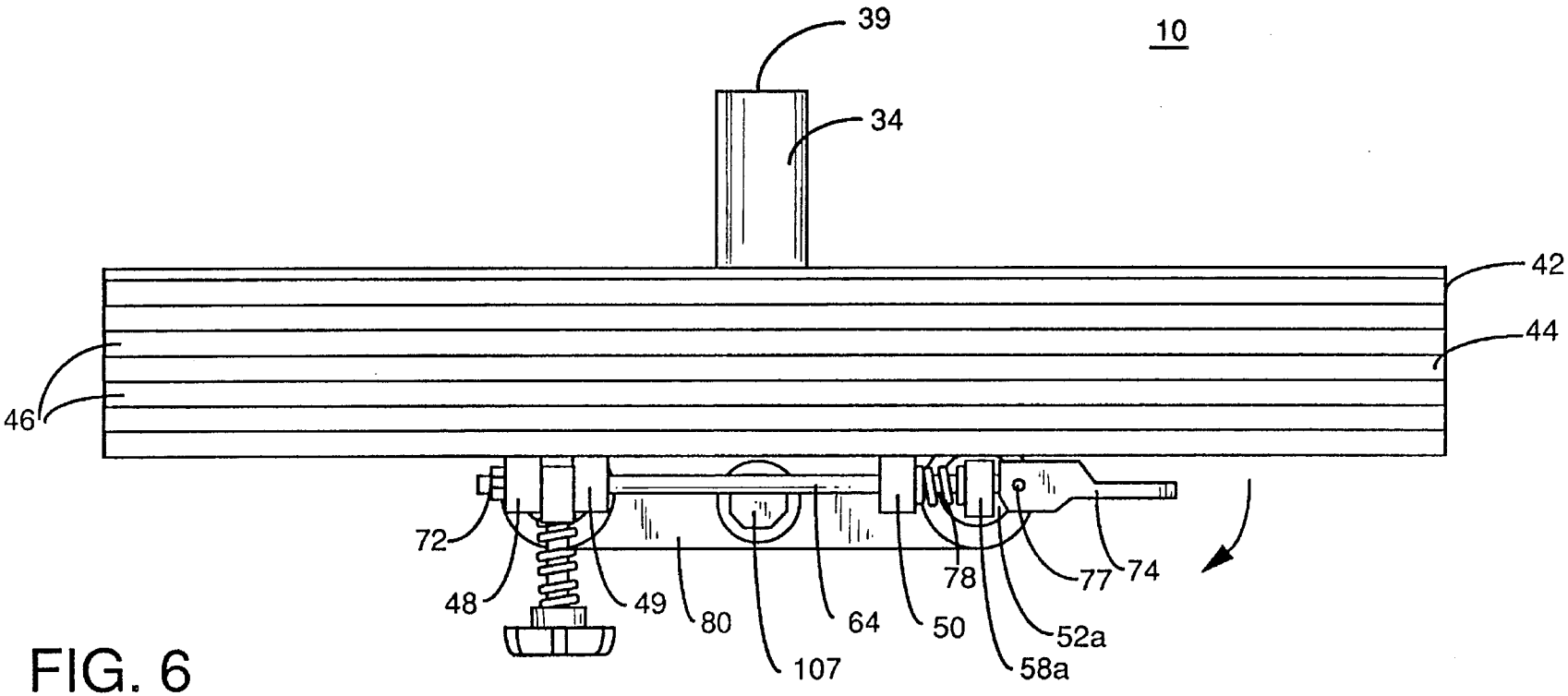
FIG. 6 is a top view of the preferred embodiment of the tool platform of the present invention showing the cam member in a first open position.

Tool rest member 42 is pivotally connected to first and second post members 52*a* and 52*b*, by disposing cylindrical rod member 64 through the aligned first hinge bores (not shown) in hinge projections 48, 49, 50 and through the second hinge bores 60*a* and 60*b* in post members 52*a* and 52*b*. Rod member 64 preferably includes threaded end 66 and unthreaded end 68, the unthreaded end 68 having a rod member aperture 70 therethrough. The disposition of first post ends 58*a* and 58*b* relative to hinge projections 48, 49 and 50 when rod member 64 is disposed therethrough is best shown FIG. 3 and is such that hinge tab 58*b* is disposed intermediate and substantially adjacent hinge projections 48 and 49, while hinge tab 58*a* is disposed on a side of hinge projection 50 opposite hinge projection 49. As shown in FIGS. 3 and 6, rod member 64 is retained through the aligned first and second hinge bores by cam member 74, disposed on unthreaded end 68, and by fastening member 72, which is threadedly disposed on threaded end 66 so as to be substantially adjacent hinge projection 48.

Figure 10B:
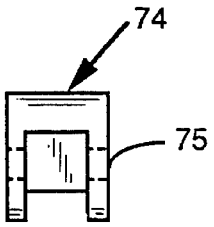
FIG. 10B is an on end view of the cam member illustrated in cross-section in FIG. 10A, taken in the direction of arrow BB in FIG. 10A.
Figure 10A:
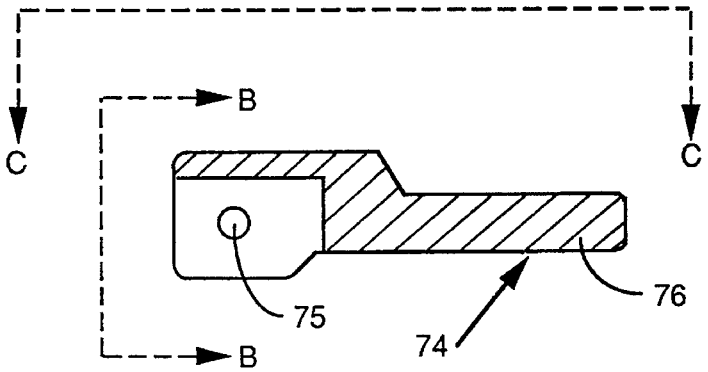
FIG. 10A is side elevational view in cross-section of the preferred configuration for the cam member of the tool platform of the present invention.
Figure 10C:
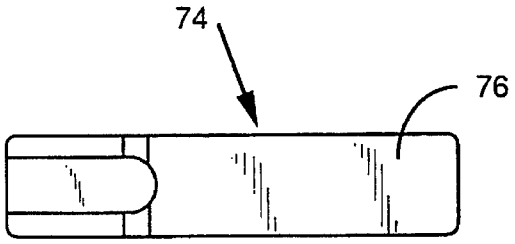
FIG. 10C is a top view of the cam member illustrated in cross-section in FIG. 10A, taken in the direction of arrow CC in FIG. 10A.

Cam member 74 is shown in isolation in FIGS. 10A, 10B and 10C, and includes cam member aperture 75 and lever portion 76. Cam member 74 is pivotally connected to unthreaded end 68 of rod member 64 by cam pivot pin 77, which is disposed through aligned rod member aperture 70 and cam member aperture 75 such that the cam member is disposed adjacent hinge tab 58*a* as shown in FIG. 6 and is pivotally moveable relative to rod member 64. Hinge coil spring 78 is also disposed on rod member 64 intermediate hinge projection 50 and hinge tab 58*a* and acts to bias apart these elements.

In addition to the above-described elements, tool platform 10 further includes bracket member 80, shown in isolation in FIGS. 11A and 11B, which includes substantially cylindrical, upstanding first and second post member receiving portions 82*a* and 82*b* connected by flattened bridge portion 83. The post member receiving apertures 84*a* and 84*b* are disposed so as to have substantially parallel longitudinal axes. Each post member receiving portion 82*a* and 82*b* includes a corresponding cylindrical post member receiving aperture 84*a* and 84*b*. Bridge portion 83 includes bolt bore 86 therethrough which is preferably bordered by hexagonal pocket 88 configured to receive and retain the hexagonal head of a machine bolt so as to prevent the bolt from turning on its longitudinal axis.

Attachment portion 12, described above, depends from a central region of bridge portion 83 by mounting member 28. The attachment portion 12 and bridge member 80 are preferably disposed so that the parallel longitudinal axes of the post member receiving apertures 84*a* and 84*b* are substantially perpendicular to the longitudinal axis of first bore 30 in the attachment portion 12. As shown in the Figures, the cylindrical second end 56*a* and 56*b* of each post member 52*a* and 52*b* is slidingly received by the corresponding post member receiving aperture 84*a* and 84*b* such that retaining aperture 62*a*, 62*b* of each post member 52*a*, 52*b*, extends beyond the corresponding post member receiving portion 82*a*, 82*b*.

Figure 12A:
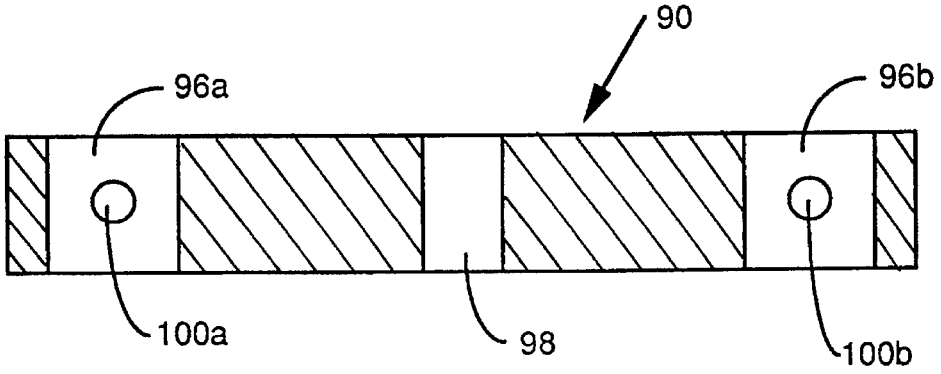
FIG. 12A is a side view in cross-section through the longitudinal axis of the preferred configuration of the beam member of the tool platform of the present invention.
Figure 12B:
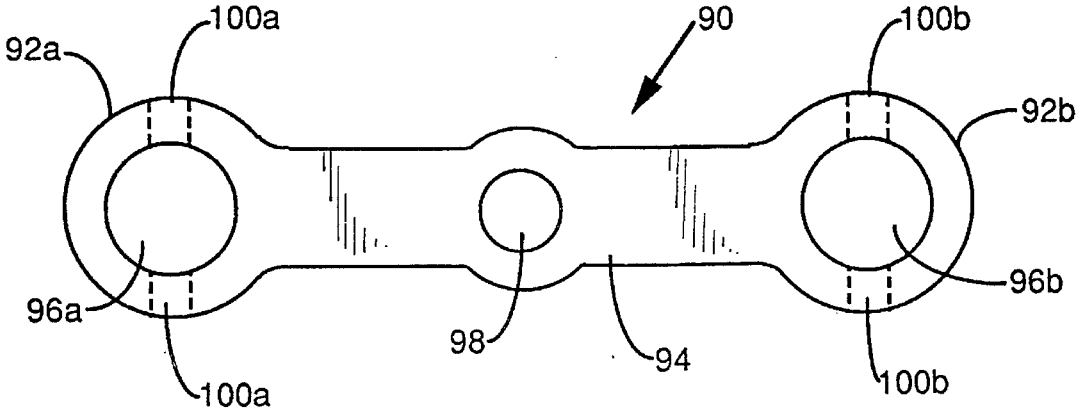
FIG. 12B is a top view of the beam member of FIG. 12A.

Beam member 90, shown in isolation in FIGS. 12A and 12B, has a substantially flattened profile and includes first and second cylindrical sleeve portions 92*a* and 92*b*, respectively, connected by spanning portion 94. Each sleeve portion 92*a* and 92*b* defines a corresponding first and second post member retaining bore 96*a* and 96*b*, respectively. Each sleeve portion 92*a* and 92*b*further includes a pin-receiving bore 100*a* and 100*b* therethrough having a longitudinal axis which intersects at right angles the longitudinal axes of the post member retaining bores 96*a* and 96*b*. Spanning portion 94 includes bolt-receiving bore 98 therethrough.

To slidingly retain the second post ends 56*a* and 56*b* in bracket member 80, the portion of each second post end 56*a* and 56*b*which extends beyond bracket member 80 is preferably first disposed through corresponding helical spring 95*a* and 95*b* and is then introduced into the corresponding first and second post member receiving aperture 96*a* and 96*b* such that the pin-receiving bores 100*a* and 100*b* in the beam member 90 align with She corresponding retaining apertures 62*a* and 62*b* in the post members. As indicated in FIG. 5, the post members 52*a* and 52*b*, are retained in beam member 90 by disposing a pin member 102 through the aligned retaining apertures 62*a*, 62*b* and pin-receiving bores 100*a*, 100*b*.

Considering the relation of the elements presented to this joint, the tool platform of the present invention broadly includes (i) a carriage assembly (generally including, in the preferred embodiment of the tool platform of the present invention, post members 52*a* and 52*b*, and beam member 90) which is slidingly moveable relative to (ii) a support assembly (generally including, in the preferred embodiment of the tool platform of the present invention, bracket member 80 and attachment member 12). In addition, the present invention also includes (iii) a tool rest member movably connected to the carriage assembly and having a tool-receiving surface for receiving thereon the tool to be ground or sharpened on the abrading machine. The preferred configuration of the means to adjust the positions of the moveable portions of tool platform 10 will now be described.

To adjust the extension of tool rest member 44 relative to bracket member 80, a threaded rod-like member, preferably elongated machine bolt 105 having hexagonal head 107, is disposed through bolt bore 86 so that hexagonal head 107 nests within hexagonal pocket 88 and is thereby prevented from turning on its longitudinal axis relative to bracket member 80. The threaded portion of machine bolt 105 extends beyond bracket member 80 and is then disposed through bolt-receiving bore 98 in beam member 90. First knob member 106, preferably having knurled portion 108 for facilitating rotation by hand, is threadedly received on the threaded end of machine bolt 105 which extends beyond beam member 90.

It will be understood from the above-described arrangement of the elements that by threadedly advancing first knob member 106 along the threaded portion of machine bolt 105, first knob member 106 will bias beam member 90 to move in relation to bracket member 80, thereby causing post members 52*a* and 52*b*, to slide within the corresponding post member receiving apertures 84*a* and 84*b*. In this way, tool rest member 42, attached to the post members 52*a* and 52*b*, may be positioned in relation to bracket member 80. Helical springs 95*a* and 95*b* act to bias beam member 90 against first knob member 106, but do not exert force Sufficient to prevent the threaded movement of first knob member 106 along machine bolt 105.

Figure 7:
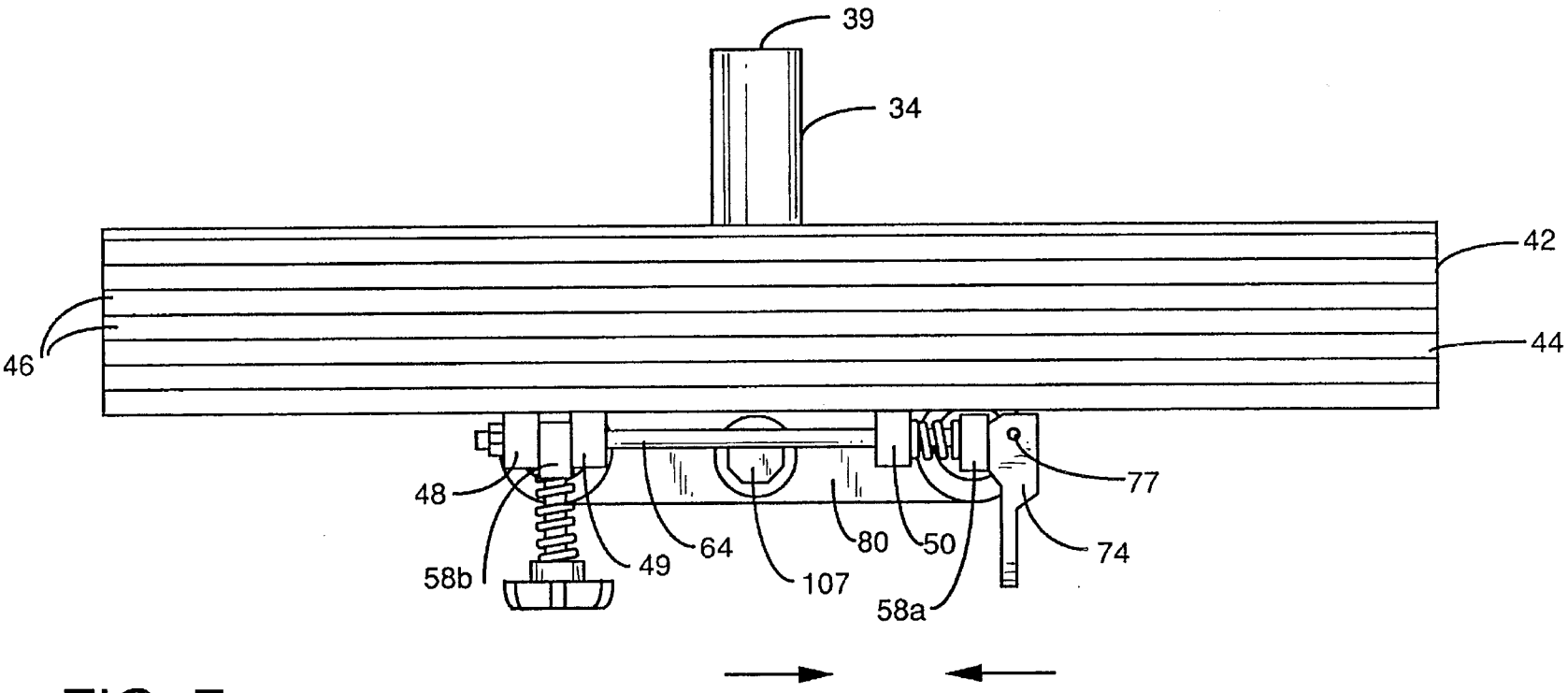
FIG. 7 is a top view of the preferred embodiment of the tool platform of the present invention showing the cam member in a second compressing position.

Cam member 74 and the above-described arrangement of hinge tabs 58*a* and 58*b* of the post members 52*a* and 52*b* relative to hinge projections 48, 49 and 50, provides a means whereby the cylindrical second ends 56*a* and 56*b* of post members 52*a* and 52*b* may be locked within post member receiving apertures 84*a* and 84*b* of bracket member 80. As illustrated in FIGS. 6 and 7, the cam member 74 is pivotable on cam pivot pin 77 between an open position (FIG. 6) and a compressing position (FIG. 7). As will be understood by consideration of FIGS. 6 and 7, the position of post members 52*a* and 52*b*may be locked in relation to bracket member 80 by rotating cam member 74 on cam pivot pin 77 as shown by the arrow in FIG. 6 so as to assume its compressing position (shown in FIG. 7) wherein the eccentrically-shaped surface of cam member 74 pushes against adjacent hinge tab 58*a*.

Because rod member 64 is fixed at its threaded end 66 by fastening member 72, the rotation of cam member 74 into the compressing position shown in FIG. 7 shortens the effective length of rod member 64 and forces hinge tabs 58*a* and 58*b* toward each other as indicated by the arrows in FIG. 7. This compressing together of hinge tabs 58*a* and 58*b* causes the outer surface of post members 52*a* and 52*b*, to forcefully contact the inner surface of the corresponding post member receiving apertures 84*a* and 84*b*, thereby frictionally locking the position of post members 52*a* and 52*b*, relative to bracket member 80.

Tool platform 10 additionally includes means to adjust the angular position of tool rest member 42 relative to post members 52*a* and 52*b*. As shown in FIG. 5, second post member 52*b*, includes threaded hole 110 therethrough in a position adjacent hinge tab 58*b*. Second knob member 112 includes a knob portion 114 and a threaded portion 116, the threaded portion 116 being disposed through coil spring 118 and then being threadedly received by threaded hole 110. As best shown in FIG. 4, a surface of tool rest member 42 opposite tool-receiving surface 44 includes peg 122 depending therefrom, the peg 122 being disposed so that the threaded portion 116 of second knob member 112 which extends from threaded hole 110 impinges on peg 122. Because tool rest member 42 is pivotable relative to second post member 52*b*, it will be understood that by threadedly advancing or retracting second knob member 112 through threaded hole 110, the angular position of tool rest member 42 relative to post members 52*a* and 52*b*, may be adjusted as indicated by the arrow in FIG. 4.

As shown in FIG. 1, the above-described preferred embodiment for the tool platform of the present invention may be attached to an abrading machine by introducing stalk member 34, which is retained within first bore 30 of attachment portion 12, into a collar member 124 disposed on the housing of abrading machine 5 adjacent horizontal sharpening wheel 7. Collar member 124 is configured similar to attachment portion 12 in that it includes a bore for receiving stalk member 34 and also includes a bolt 126 which protrudes into the bore. Bolt 126 is advanced into slot 36 of stalk member 34 to thereby releasibly attach tool platform 10 to abrading machine 5.

It will be understood that when tool platform 10 is so-attached to abrading machine 5, bracket member 80 will be in a stationary position relative to wheel 7 and rotation of first knob member 106 will adjust the elevation of tool rest member 42 and tool-receiving surface 44 relative to the sharpening surface 23 of horizontal sharpening wheel 7. Also, rotation of second knob member 112 to thereby threadedly advance or retract the second knob member within threaded hole 110 in second post member 52*b*, will provide for the adjustment of the angular orientation of the tool-receiving surface 44 relative to sharpening surface 23 of horizontal sharpening wheel 7. Accordingly, by manipulating the first and second knob members 106 and 114, respectively, a selected elevation and angular orientation of tool-receiving surface 44 relative to sharpening surface 23 may be provided. In this same manner, a predetermined elevation and orientation of a tool received on tool-receiving surface 44 relative to sharpening surface 23 may be provided.

Figure 8:
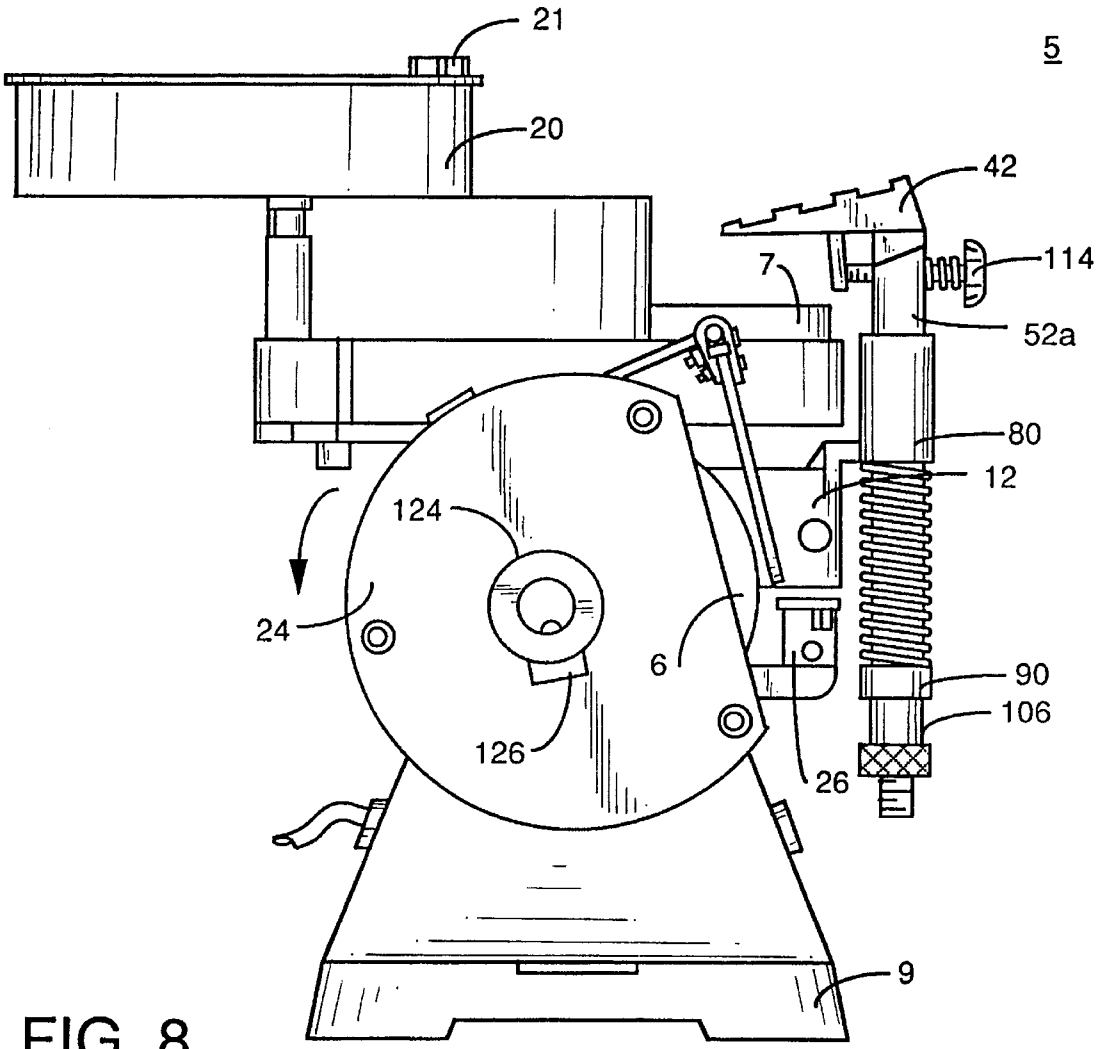
FIG. 8 is a side elevational view of the preferred embodiment of the two-station abrading machine of the present invention showing the preferred embodiment of the tool platform of the present invention disposed adjacent the horizontal sharpening wheel of the abrading machine.
Figure 9:
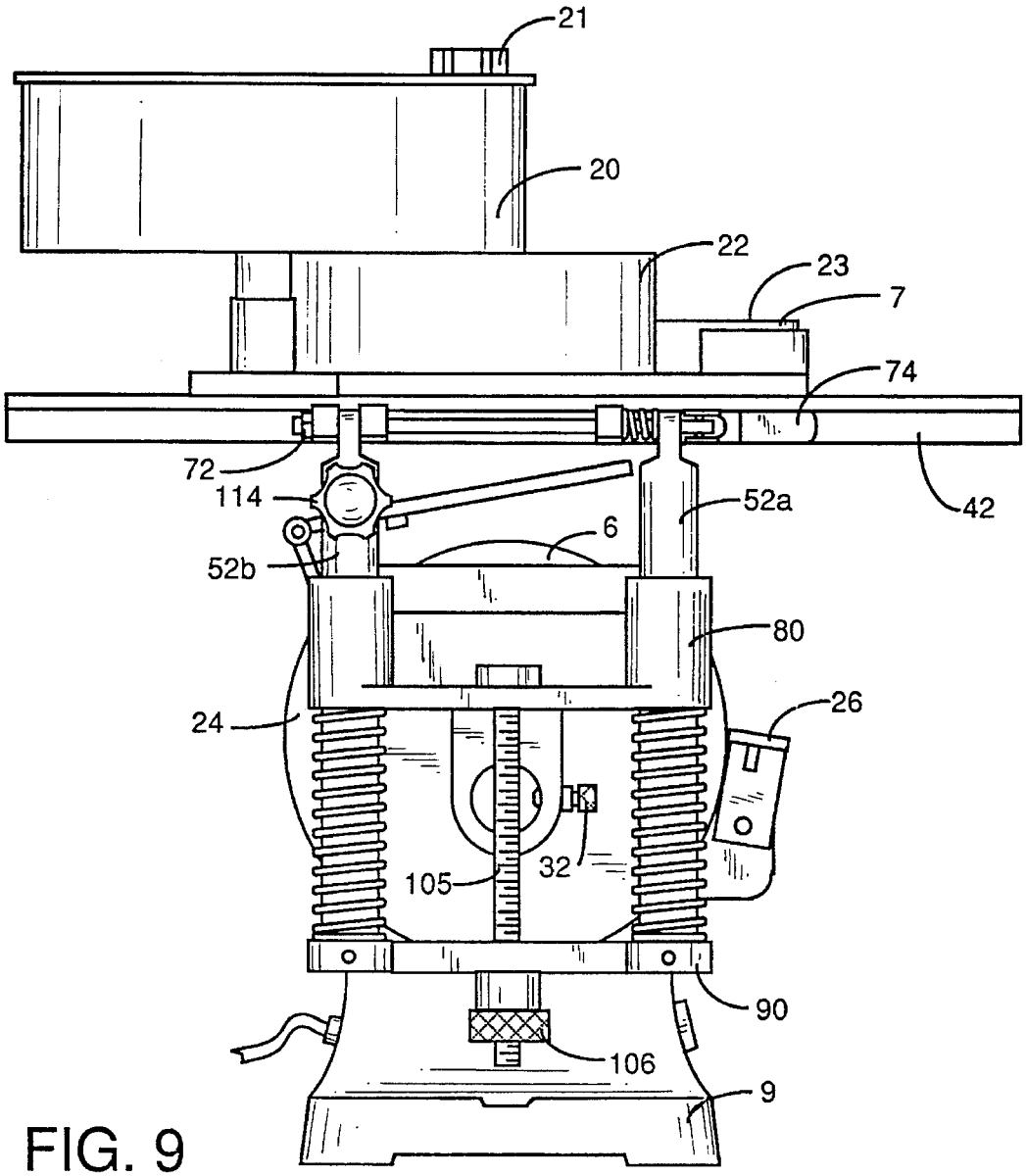
FIG. 9 is a side elevational view of the preferred embodiment of the two-station abrading machine of the present invention showing the preferred embodiment of the tool platform of the present invention disposed adjacent the vertical grinding wheel of the abrading machine.

A preferred embodiment for a two-station abrading machine 5 of the present invention further includes a collar member 124 adjacent vertical grinding wheel 6 as well as horizontal sharpening wheel 7. The collar member 124 adjacent vertical grinding wheel 6 is shown in FIG. 8. To releasibly attach tool platform 10 adjacent vertical grinding wheel 6, housing 24, which surrounds the major portion of vertical grinding wheel 6 and is rotatable with respect thereto on an axis corresponding to the axis of rotation of wheel 6, is rotated from the position shown in FIG. 8 (in the direction indicated by the arrow in FIG. 8), wherein a front-facing portion of wheel 6 is exposed, to a position wherein a top portion of the vertical grinding wheel 6 is exposed. As shown in FIG. 9, tool platform 10 may then be attached by stalk member 34 to the collar member 124 adjacent the vertical grinding wheel 6. Accordingly, in the two-station abrading machine of the present invention, adjustable tool platform 10 may be disposed adjacent either vertical grinding wheel 6 or horizontal sharpening wheel 7, depending on whether the tool to be supported on tool platform 10 is to be ground or sharpened.

The two collar members 124 of the two-station abrading machine 5 of the present invention are disposed relative to both the vertical and horizontal grinding wheels 6 and 7 such that bracket member 80 is positioned in an identical orientation relative to either the sharpening surface 23 of horizontal Sharpening wheel 7 or the exposed top portion of vertical grinding wheel 6 when tool platform 10 is disposed on the collar member adjacent thereto.

Therefore, tool platform 10 may first be attached adjacent vertical grinding wheel 6 and first and second knob members 106 and 112 may be adjusted to provide for a selected elevation and angular orientation of the tool-receiving surface 44 relative to the exposed grinding surface of vertical grinding wheel 6. The tool to be ground may then be supported on the tool-receiving surface 44 at the tool-receiving surface's selected elevation and angular orientation so that the tool is supported at a predetermined elevation and angular orientation necessary to effectively and efficiently remove surface imperfections therefrom. After removing surface imperfections from the tool edge, the entire tool platform 10 may be detached from the abrading machine 5 and stalk member 34 may be attached to the collar member 124 adjacent horizontal sharpening wheel 7 while still retaining the same elevation and angular orientation of the tool-receiving surface 44 relative to the operative sharpening surface 23 of the horizontal sharpening wheel 7. In this way, the same tool supported on the tool-receiving disposed adjacent the horizontal sharpening wheel will be in the same predetermined elevation and angular orientation relative to the abrading surface.

Although the foregoing description relates to a two-station abrading machine, i.e., an abrading machine having two abrading wheels, it will be understood that the tool platform of the present invention may be incorporated as an element of a multiple-station abrading machine having any number of abrading wheels.

Accordingly, the present invention provides an adjustable tool platform having means for adjusting both the elevation of a carriage portion of the tool platform relative to a support portion and the angular orientation of a tool rest portion. The present invention also provides for an abrading machine including the adjustable tool platform of the present invention either releasibly or fixedly attached thereto. Finally, the present invention provides for a multiple-station abrading machine including an adjustable tool platform which may be positioned at two or more abrading stations of the abrading machine while maintaining a selected orientation of the tool rest member of the tool platform relative to the operative abrading surface.

It will be understood that various changes in the details, materials, and arrangement of elements which have been herein described and illustrated to explain the nature of the invention may be made by those skilled in the art and that these changes are within the principle and scope of the invention as expressed in the appended claims.

What is claimed:

1. An adjustable tool platform for selectively disposing a tool at a predetermined elevation and angular position relative to an abrading surface of an abrading machine, the tool platform comprising:

(a) a carriage assembly comprising a post member having first and second ends;

(b) a support assembly comprising an attachment portion and a bracket member, said attachment portion for attaching said support assembly to an abrading machine, said bracket member for receiving said second end of said post member, said post member being received on and moveable with respect to said bracket member;

(c) a tool rest member pivotally connected to said first end of said carriage assembly, said tool rest member including a tool-receiving surface for receiving the tool, said tool-receiving surface being moveable with respect to the abrading surface such that the predetermined angular position and elevation may be selected;

(d) angular position selecting means operably connected to said tool rest member for pivotally adjusting said tool rest member relative to said carriage assembly to thereby adjust said tool-receiving surface to a selected angular position relative to the abrading surface so as to position to the predetermined angular position the tool received on said tool-receiving surface; and (e) elevation selecting means operably connected between said carriage assembly and said support assembly for adjusting said tool-receiving surface to a selected elevation relative to the abrading surface to thereby adjust to the predetermined elevation the tool received on said tool-receiving surface.

2. The tool platform of claim 1 wherein said tool rest member includes a first bore, said first end of said post member having a second bore therethrough, said tool platform further comprising a first rod member securedly disposed through said first and second bore to thereby pivotally connect said tool rest member to said post member.

3. The tool platform of claim 1 wherein said bracket member comprises a hollow receiving means, said second end of said post member being slidably received by said receiving means.

4. The tool platform of claim 3 wherein said carriage assembly further comprises a beam member, said second end of said post member being fixedly connected to said beam member such that said receiving means is disposed intermediate said beam member and said tool rest member.

5. The tool platform of claim 4 wherein said beam member includes an opening therethrough and wherein said elevation selecting means comprises a second rod member, said second rod member having a primary end and a threaded secondary end, said primary end being disposed on said bracket member, said threaded secondary end being disposed through said opening in said beam member, said threaded secondary end being secured through said opening in said beam member by a first knob member threadedly received on said threaded secondary end, said post member being moveable relative to said receiving means by threadedly advancing said first knob member along said threaded secondary end to thereby correspondingly move said beam member.

6. The tool platform of claim 5 wherein said elevation selecting means further comprises a first biasing means for biasing said beam member against said first knob member.

7. The tool platform of claim 6 wherein said biasing means comprises a coil spring, said coil spring being received on said post member intermediate said receiving means and said beam member.

8. The tool platform of claim 1 wherein said first end of said post member includes a threaded aperture therethrough and wherein said angular position selecting means comprises a second knob member including at least a threaded shaft portion, said threaded shaft portion being threadedly received by said threaded aperture and contacting said tool rest member, said second knob member causing said tool rest member to pivot relative to said post member when said threaded shaft portion of said second knob member is threadedly advanced through said threaded aperture.

9. The tool platform of claim 4, further comprising elevation locking means operably connected to said carriage assembly, said elevation locking means for selectively inhibiting the movement of said carriage assembly relative to said support assembly.

10. The tool platform of claim 1 wherein said carriage assembly comprises two oblong post members disposed with their longitudinal axes substantially parallel, each said post member having at least a first end and a second end, said tool rest member being pivotally connected to each said first end, each said second end being slidingly received by said bracket member.

11. The tool platform of claim 10 wherein said tool rest member comprises one or more first bores, and wherein each said first end of said post members includes a second bore therethrough, said tool platform further comprising a first rod member disposed through said first and second bores to thereby pivotally connect said tool rest member to said post members.

12. The tool platform of claim 11 wherein said bracket member comprises a receiving means, said second ends of said post members being slidably received by said receiving means.

13. The tool platform of claim 12 wherein said carriage means further comprises a beam member, each of said second ends of each of said post members being fixedly connected to said beam member such that said receiving means is disposed intermediate said beam member and said tool rest member.

14. The tool platform of claim 13 wherein said beam member includes an opening therethrough and wherein said elevation selecting means comprises a second rod member including a primary end and a threaded secondary end, said primary end being disposed on said bracket member, said threaded secondary end being disposed through said opening in said beam member, said threaded secondary end being secured through said opening in said beam member by a first knob member threadedly received on said threaded secondary end, said post member being moveable relative to said receiving means by threadedly advancing said first knob member along said threaded secondary to thereby correspondingly move said beam member.

15. The tool platform of claim 14 wherein said elevation selecting means further comprises a first biasing means for biasing said beam member against said first knob member.

16. The tool platform of claim 15 wherein said biasing means comprises a coil spring, said coil spring being received on one of said post members intermediate said receiving means and said beam member.

17. The tool platform of claim 16 wherein said first end of at least one of said post members includes a threaded aperture therethrough and wherein said angular adjustment means comprises a second knob member including a threaded shaft portion, said threaded shaft portion being threadedly received in said threaded aperture and contacting said tool rest member, said second knob member causing said tool rest member to pivot relative to said post member when said threaded shaft portion of said second knob member is threadedly advanced through said threaded aperture.

18. The tool platform of claim 17 wherein said tool rest member further includes a projecting flange, said threaded shaft portion of said second knob member impinging on said projecting flange.

19. The tool platform of claim 18, further comprising elevation locking means operably connected to said carriage assembly for selectively inhibiting the movement of said carriage assembly relative to said bracket member.

20. The tool platform of claim 19 wherein said receiving means includes two voids having at least an inner surface, said post members slidingly received within said voids so that an outer surface of said second ends of each of said post members opposes said inner surface of each of said cylindrical voids.

21. The tool platform of claim 20 wherein said elevation locking means comprises compression means to selectively bias together said first ends of said post members, thereby causing said outer surface of each of said post members to frictionally contact said inner surface of each of said voids, thereby inhibit said post members from sliding relative to receiving means.

22. The tool platform of claim 21 wherein said first rod member disposed through said first and second bores includes a first terminal end and a second terminal end, said first and second terminal ends extending beyond said first and second bores, said first terminal end having a cap means thereon, said compression means comprising a cam member having a camming surface, said cam member rotatably connected to said second terminal end adjacent said first end of one of said post members, said cam member rotatable on a cam rotation axis between a first open position wherein said camming surface does not forcibly impinge on said first end of said post member adjacent said cam member, and a second compressing position wherein said camming surface forcibly impinges on said first end of said post member adjacent said cam member and thereby biases together said first ends of said post members to thereby causing said outer surface of each of said post members to frictionally contact said inner surface of each of said voids.

23. An abrading machine useful for abrading material from a tool, the abrading machine comprising:

a base portion;

a motor connected to said base portion;

an abrading surface operably connected to said motor, said abrading surface being selectively driven to rotate by said motor; and an adjustable tool platform for selectively disposing a tool at a predetermined elevation and angular position relative to said abrading surface, said tool platform comprising:

(a) a carriage assembly comprising a post member having first and second ends;

(b) a support assembly comprising an attachment portion and a bracket member, said attachment portion for attaching said support assembly to an abrading machine, said bracket member for receiving said second end of said post member, said post member being received on and moveable with respect to said bracket member;

(c) a tool rest member pivotally connected to said first end of said carriage assembly said tool rest member including a tool-receiving surface for receiving the tool, said tool-receiving surface being moveable with respect to the abrading surface such that the predetermined angular position and elevation may be selected;

(d) angular position selecting means operably connected to said tool rest member for pivotally adjusting said tool rest member relative to said carriage assembly to hereby adjust said tool-receiving surface to a selected angular position relative to the abrading surface so as to position the tool received on said tool-receiving surface to the predetermined angular position; and (e) elevation selecting means operably connected between said carriage assembly and said support assembly for adjusting said tool-receiving surface to a selected elevation relative to the abrading surface to thereby adjust to the predetermined elevation the tool received on said tool-receiving surface.

24. The abrading machine of claim 23 wherein said tool rest member includes a first bore, said first end of said post member having a second bore therethrough, said tool platform further comprising a first rod member securedly disposed through said first and second bore to thereby pivotally connect said tool rest member to said post member.

25. The tool platform of claim 24 wherein said bracket member comprises a hollow receiving means, said second end of said post member being slidably received by said receiving means.

26. The abrading machine of claim 25 wherein said carriage assembly further comprises a beam member, said second end of said post member being fixedly connected to said beam member such that said receiving means is disposed intermediate said beam member and said tool rest member.

27. The abrading machine of claim 26 wherein said beam member includes an opening therethrough and wherein said elevation selecting means comprises a second rod member, said second rod member having a primary end and a threaded secondary end, said primary end being disposed on said bracket member, said threaded secondary end being disposed through said opening in said beam member, said threaded secondary end being secured through said opening in said beam member by a first knob member threadedly received on said threaded secondary end, said post member being moveable relative to said receiving means by threadedly advancing said first knob member along said threaded secondary end to thereby correspondingly move said beam member.

28. The abrading machine of claim 27 wherein said elevation selecting means further comprises a first biasing means for biasing said beam member against said first knob member.

29. The abrading machine of claim 28 wherein said biasing means comprises a coil spring, said coil spring being received on said post member intermediate said receiving means and said beam member.

30. The abrading machine of claim 23 wherein said first end of said post member includes a threaded aperture therethrough and wherein said angular position selecting means comprises a second knob member including at least a threaded shaft portion, said threaded shaft portion being threadedly received by said threaded aperture and contacting said tool rest member, said second knob member causing said tool rest member to pivot relative to said post member when said threaded shaft portion of said second knob member is threadedly advanced through said threaded aperture.

31. The abrading machine of claim 23, further comprising elevation locking means operably connected to said carriage assembly for selectively inhibiting the movement of said carriage assembly relative to said support assembly.

32. The abrading machine of claim 23 wherein said carriage assembly comprises two oblong post members disposed with their longitudinal axes substantially parallel, each said post member having at least a first end and a second end, said tool rest member being pivotally connected to each said first end, each said second end being slidingly received by said bracket member.

33. The abrading machine of claim 32 wherein said tool rest member comprises one or more first bores, and wherein each said first end of said post members includes a second bore therethrough, said tool platform further comprising a first rod member disposed through said first and second bores to thereby pivotally connect said tool rest member to said post members.

34. The abrading machine of claim 33 wherein said bracket member comprises a receiving means, said second ends of said post members being slidably received by said receiving means.

35. The abrading apparatus of claim 34 wherein said carriage means further comprises a beam member, each of said second ends of each of said post members being fixedly connected to said beam member such that said receiving means is disposed intermediate said beam member and said tool rest member.

36. The abrading apparatus of claim 35 wherein said beam member includes an opening therethrough and wherein said elevation selecting means comprises a second rod member including a primary end and a threaded secondary end, said primary end being disposed on said bracket member, said threaded secondary end being disposed through said opening in said beam member, said threaded secondary end being secured through said opening in said beam member by a first knob member threadedly received on said threaded secondary end, said post member being moveable relative to said receiving means by threadedly advancing said first knob member along said threaded secondary to thereby correspondingly move said beam member.

37. The abrading machine of claim 36 wherein said elevation selecting means further comprises a first biasing means for biasing said beam member against said first knob member.

38. The abrading machine of claim 32 wherein said biasing means comprises a coil spring, said coil spring being received on one of said post members intermediate said receiving means and said beam member.

39. The abrading machine of claim 38 wherein said first end of at least one of said post members includes a threaded aperture therethrough and wherein said angular adjustment means comprises a second knob member including a threaded shaft portion, said threaded shaft portion being threadedly received in said threaded aperture and contacting said tool rest member, said second knob member causing said tool rest member to pivot relative to said post member when said threaded shaft portion of said second knob member is threadedly advanced through said threaded aperture.

40. The abrading machine of claim 39 wherein said tool rest member further includes a projecting flange, said threaded shaft portion of said second knob member impinging on said projecting flange.

41. The abrading machine of claim 40, further comprising elevation locking means operably connected to said carriage assembly for selectively inhibiting the movement of said carriage assembly relative to said bracket member.

42. The abrading apparatus of claim 41 wherein said receiving means includes two voids having at least an inner surface, said post members slidingly received within said voids so that an outer surface of said second ends of each of said post members opposes said inner surface of each of said cylindrical voids.

43. The abrading machine of claim 42 wherein said elevation locking means comprises compression means to selectively bias together said first ends of said post members, thereby causing said outer surface of each of said post members to frictionally contact said inner surface of each of said voids, thereby Inhibit said post members from sliding relative to receiving means.

44. The abrading apparatus of claim 43 wherein said first rod member disposed through said first and second bores includes a first terminal end and a second terminal end, said first and second terminal ends extending beyond said first and second bores, said first terminal end having a cap means thereon, said compression means comprising a cam member having a camming surface, said cam member rotatably connected to said second terminal end adjacent said first end of one of said post members, said cam member rotatable on a cam rotation axis between a first open position wherein said camming surface does not forcibly impinge on said first end of said post member adjacent said cam member, and a second compressing position wherein said camming surface forcibly impinges on said first end Of said post member adjacent said cam member and thereby biases together said first ends of said post members to thereby causing said outer surface of each of said post members to frictionally contact said inner surface of each of said voids.

45. A abrading machine having multiple abrading stations useful for abrading material from a tool, the abrading machine comprising:

a base portion;

a motor connected to said base portion;

a housing portion including at least first and second attachment portions thereon;

at least first and second abrading surfaces rotatably disposed on said housing portion and operably connected to said motor, each of said abrading surfaces being selectively driven to rotate by said motor, said first attachment portion being disposed on said housing adjacent said first abrading surface and said second attachment portion being disposed on said housing adjacent said second abrading surface; and an adjustable tool platform having a tool-receiving surface disposable at a selected elevation and angular orientation relative to said abrading surfaces, said tool platform selectively attachable at either of said first and second attachment portions, said tool-receiving surface maintaining said selected elevation and angular orientation relative to said first and second abrading surfaces without readjustment when said tool platform is moved from said first attachment portion to said second attachment portion.

46. The multiple station abrading machine of claim 45 wherein said adjustable tool platform comprises:

(a) a support assembly comprising a bracket member and a second attachment portion, said second attachment portion for attaching said support assembly to any of said first attachment portions on said housing;

(b) a carriage assembly received on and moveable with respect to said support assembly;

(c) a tool rest member connected to said carriage assembly, said tool rest member including said tool-receiving surface, said tool rest member being moveable with respect to said carriage assembly so that the selected angular position and elevation may be achieved;

(d) angular position selecting means operably connected to said tool rest member for adjusting said tool-receiving surface to said selected angular position; and (e) elevation selecting means operably connected between said carriage assembly and said support assembly for adjusting said tool-receiving surface to said selected elevation;

each of said first attachment portions disposed adjacent one of said abrading surfaces such that when said tool platform is attached to any of said first attachment portions, said bracket member is disposed in a substantially identical position relative to the adjacent said abrading surface.

* * * * *

UNITED STATES PATENT AND TRADEMARK OFFICE

CERTIFICATE OF CORRECTION

PATENT NO. : 5,505,655
DATED : April 9, 1996
INVENTOR(S) : Jeffrey L. Haffely, Xun Lei and Louis C. Brickner It is certified that error appears in the above-indentified patent and that said Letters Patent is hereby corrected as shown below:

In column 12, line 41, delete "claim 4" and insert therefor -- claim 1 --.

In column 16, line 5, delete "claim 32" and insert therefor -- claim 37 --.

Signed and Sealed this

Seventeenth Day of June, 1997

Bruce Lehman

*Attest:*

BRUCE LEHMAN

*Attesting Officer*

*Commissioner of Patents and Trademarks*